US007618041B1

(12) United States Patent
Sterling

(10) Patent No.: US 7,618,041 B1
(45) Date of Patent: Nov. 17, 2009

(54) FIST POWERED AMUSEMENT GAME

(76) Inventor: Monte Quenten Sterling, 7B Cloninger Ln, Bozeman, MT (US) 59716

( * ) Notice: Subject to any disclaimer, the term of this patent is extended or adjusted under 35 U.S.C. 154(b) by 0 days.

(21) Appl. No.: 12/235,945

(22) Filed: Sep. 23, 2008

(51) Int. Cl.
*A63F 7/00* (2006.01)

(52) U.S. Cl. ..... 273/119 R; 273/119 A; 273/121 R; 273/121 B

(58) Field of Classification Search ..... 273/109, 273/118 R, 118 A, 118 D, 119 R, 119 A, 273/120 R, 120 A, 121 R, 121 A, 121 B, 273/127 R, 129 R, 129 T, 129 V, 129 W, 440, 273/451, 459, 460, 317, 340
See application file for complete search history.

(56) References Cited

U.S. PATENT DOCUMENTS 3,582,075 A * 6/1971 Glass et al. ..... 273/317
4,136,872 A * 1/1979 Matsumoto ..... 273/317.3
4,186,926 A 2/1980 Kulesza et al.
4,273,341 A * 6/1981 Warrix ..... 273/357
5,149,095 A * 9/1992 Kashimoto et al. ..... 273/121 B
5,695,194 A 12/1997 Nagel
6,270,080 B1 * 8/2001 Chang ..... 273/399

FOREIGN PATENT DOCUMENTS

GB 2191101 A * 12/1987
JP 05220256 A * 8/1993

* cited by examiner

*Primary Examiner*—Raleigh W. Chiu
(74) *Attorney, Agent, or Firm*—Louis Ventre, Jr.

(57) ABSTRACT

An arcade game machine of physical exertion, skill and chance for a player wherein a player uses a fist to hit a cushion that is connected to a lever mechanism within the game machine. The lever mechanism is composed of three elements about a fulcrum attached to the game machine. Upon impact with the cushion, the lever mechanism launches a ball vertically. A reflector diverts the launched ball into the playing field. One or more player-movable paddles within the playing field may be manipulated by the player to send the ball to a target within the playing field. Successful manipulation may be awarded a prize.

3 Claims, 2 Drawing Sheets

FIST POWERED AMUSEMENT GAME

TECHNICAL FIELD

In the field of amusement devices and arcade games, a game machine enables striking manipulation by a player in order to impel a projectile resting on a surface into the air enclosed within the game machine by striking a lever holding the projectile from below.

BACKGROUND ART

Games that involve launching a ball with a lever within a confined housing are known. These generally involve sending a ball in an arc to a destination bowl or target. Such games do not require significant physical exertion and subsequent skill in maneuvering the ball to a target location.

One such example is U.S. Pat. No. 5,695,194 is for a game that has a transparent dome mounted to a hollow base with game balls enclosed therein. The base has a top surface comprising a shoulder and a concave cavity. Ball recesses are arranged along the shoulder. A colored lever is associated with each of the ball recesses. A motor causes the balls in the base to randomly project into the dome and randomly fall or drop into the ball recesses. The user depresses the lever and thereby ejects from the ball recess balls that do not match in color with the associated lever.

SUMMARY OF INVENTION

An arcade game machine of physical exertion, skill and chance for a player is enclosed in a housing showing a playing field. A player uses a fist to hit a cushion comprising a sponge material on the surface of the housing. The cushion is connected to a lever mechanism within the housing. Upon impact with the cushion, the lever mechanism is activated to launch a ball vertically within the housing. The lever mechanism is composed of a first element configured vertically within the housing to support a ball, a second element generally horizontal within the housing rotatably attached to the first element and configured with a fulcrum fixed to the housing at a distance from the first element, and, a third element connected to the second element such that the fulcrum is between the first element and the third element and such that the third element extends outside the housing to the cushion. A reflector, such as a plate of transparent plastic, is positioned within the housing and configured to reflect the ball into the playing field after launch of the ball from the lever mechanism. One or more player-movable surfaces within the playing field are configured to manipulate the ball to a target within the playing field. Successful manipulation may be awarded prizes.

Technical Problem

Arcade game players are typically teenagers having a significant amount of pent-up energy to expend but no games that permit expenditure of that energy in launching a ball, skillfully assessing angles and ball trajectories, manipulating the ball in action, and attempting to reach a goal in play actions that can fascinate and entertain.

Solution to Problem

A fast action game machine that enables a player to use the energy in a fist strike to a cushion to launch a ball within the machine and thereafter attempt to manipulate the careening ball to a target by orienting at least one reflecting surface.

ADVANTAGEOUS EFFECTS OF INVENTION

This is a high action, high concentration and fast reflex game that can be highly entertaining. It provides an outlet for youthful energy and promotes development of skills in recognizing angles of incidence and reflection, predicting trajectories affected by gravity and instinctively implementing actions to redirect the point of impact.

BRIEF DESCRIPTION OF DRAWINGS

The drawings illustrate preferred embodiments of the invention. The reference numbers in the drawings are used consistently throughout.

DESCRIPTION OF EMBODIMENTS

In the following description, reference is made to the accompanying drawings, which form a part hereof and which illustrate several embodiments of the present invention. The drawings and the preferred embodiments of the invention are presented with the understanding that the present invention is susceptible of embodiments in many different forms and, therefore, other embodiments may be utilized and structural, and operational changes may be made, without departing from the scope of the present invention.

Figure 1:
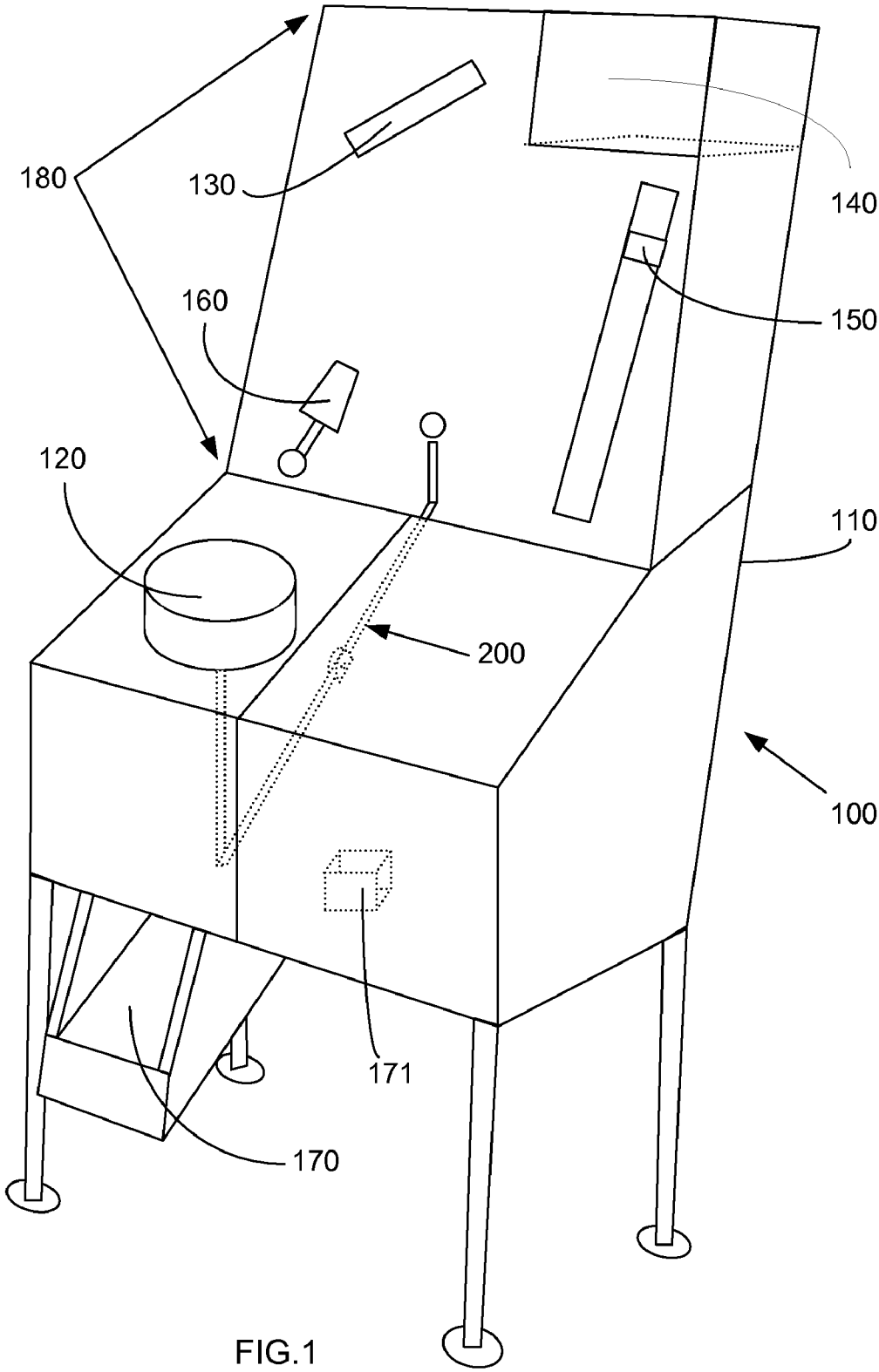
FIG. 1 is a perspective of the game machine.
Figure 2:
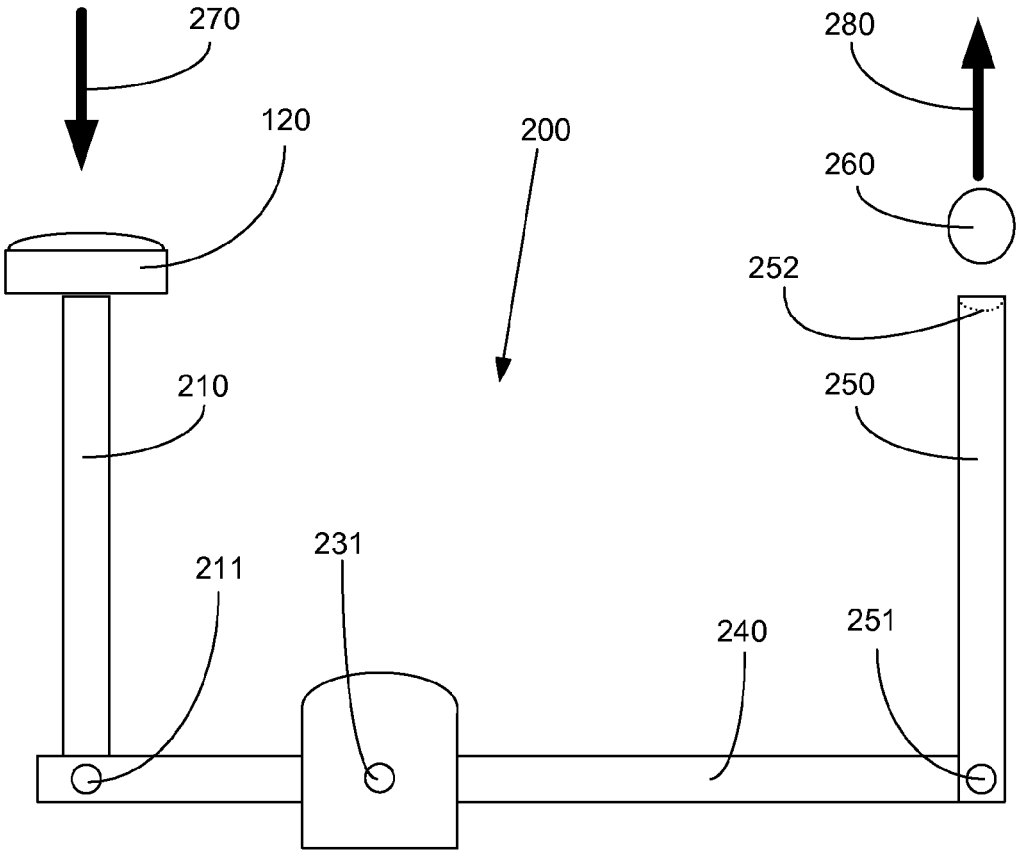
FIG. 2 is a side elevation view of the lever mechanism in the game machine.

FIG. 1 shows a perspective of an arcade game that is a preferred embodiment of game machine (100) of the invention. FIG. 2 shows a side elevation view of a lever mechanism (200) within the game. The game machine (100) is one of skill and chance for a player.

The game machine (100) first comprises a housing (110). The housing (110) comprises a playing field (180), which essentially is the volume in the upper part of the housing (110). The playing field (180) is viewable by the player and thus, the housing (110) would typically have a cover made of clear, half inch thick, PLEXIGLAS for transparent view of lever mechanics and ball action.

The game machine (100) next comprises a lever mechanism (200) to launch a ball vertically within the housing (110). The lever mechanism (200) has three elements: a first element (250) configured vertically within the housing (110) to support a ball (260); a second element (240) within the housing (110) rotatably attached, typically with a pin joint (251), to the first element (250) and configured with a fulcrum (231) fixed to the housing (110) at a distance from the first element (250); and, a third element (210) connected to the second element (240) such that the fulcrum (231) is between the first element (250) and the third element (210) and such that the third element (210) extends outside the housing (110). The joints (211, 231 and 251) may be any operable configuration supporting rotation or pivoting of one element with respect to the other. A well known alternative is a hinge. For most applications, the natural weight of the lever returns it to a resting position ready for another ball and the next strike by a player. In other configurations, a spring is added to bias the return the lever.

The game machine (100) next comprises a cushion (120) comprising a sponge-like material connected to the third element (210) outside the housing (110) such that player impact with the cushion (120) in a downward direction (270) activates the lever mechanism (200) to launch the ball (260) in an upward direction (280). Preferably the cushion is constructed with 3 inches of sponge under a $\frac{1}{8}^{th}$ inch thick piece of wood to displace energy. For best results, the wood has the same planar shape as the sponge. For example, a sponge cut with a round top-view 6 inches in diameter would have a 6-inch diameter round piece of wood, ⅛$^{th}$ inch thick atop the sponge.

The game machine (100) next comprises a reflector (130) positioned within the housing (110) above the first element (250) and configured to reflect the ball (260) into the playing field (180) after launch of the ball (260) from the lever mechanism (200). The reflector is made of any sturdy material and preferably a transparent plastic. Multiple reflectors may be positioned for different play action.

The game machine (100) next comprises a player-movable surface (160) within the playing field (180) configured to reflect the ball (260) within the playing field (180). A typical player-movable surface is a paddle. As shown in FIG. 1, the player-movable surface is connected to a handle which can be easily accessed by a player.

The game machine (100) next comprises a target (150) within the playing field (180). Any type of target is within the scope of the invention. For example a strike zone may be configured to acknowledge a ball hit in a bull's-eye. Optionally, a target is two reflectors configured in the shape of a V with a 'hole out' at the vertex of the V to confine the ball to an exit direction that is vertically down, for example, to set up a subsequent shot by the player.

The game machine (100) optionally further comprises a prize (171) within the housing (110) and a means to deliver the prize (171) to the player upon impact of the ball (260) with the target (150). Such means to deliver are well known in the art, such as a delivery bin (170) connected by chutes to the location where the prize (171) is kept. Typical prizes known in the art are tickets for redemption centers, a baseball, a football card, a capsule containing a trinket, and the like.

The game machine (100) optionally further comprises a bin (140) for holding a plurality of balls (260); and a means for dispensing a ball (260) to the lever mechanism (200). Such a means for dispensing is well known in the art and would typically comprise a channel wherein a ball (260) rolls down clear maze path to a shaped guide (252) at the end of the first element (250).

The game machine would also typically have the usual arcade game appurtenances, such as a coin or bill port to accept money inserted by a player to start a game. Electronic ball loading from ball bin (140) to shaped guide (252).

In playing the game, a player slams a fist onto the cushion (120) and the force of the impact determines ball (260) launch speed. The lever mechanism (200) ejects the ball (260) at high speed vertically to impact the reflector (130), which is typically angled at 40 to 50 degrees. The ball (260) then reflects into the playing field (180). Gravity and high speed bounces the ball (260) about the playing field (180). The player manipulates the path of the ball (260) by rotating a player-movable surface (160), which is typically one or more paddles, so that the ball (260) is projected to hit the desired target. Usually, upon successfully doing so, a prize is awarded. The value of the prize may also depend on the final outcome of play.

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has application to the gaming industry, particularly the arcade gaming industry.

What is claimed is:

1. A game machine of skill and chance for a player comprising:

(a) a housing comprising a playing field;

(b) a lever mechanism to launch a ball vertically within the housing comprising:

(1) a first element configured vertically within the housing to support a ball;

(2) a second element within the housing rotatably attached to the first element and configured with a fulcrum fixed to the housing at a distance from the first element; and, (3) a third element rotatably attached to the second element such that the fulcrum is between the first element and the third element and such that the third element extends outside the housing;

(c) a cushion comprising a sponge-like material connected to the third element outside the housing such that player impact with the cushion activates the lever mechanism to launch the ball;

(d) a reflector positioned within the housing above the first element and configured to reflect the ball into the playing field after launch of the ball from the lever mechanism;

(e) a player-movable surface within the playing field configured to reflect the ball within the playing field; and, (f) a target within the playing field.

2. The game machine of claim 1 further comprising a prize within the housing and a means to deliver the prize to the player upon impact of the ball with the target.

3. The game machine of claim 1 further comprising a bin for holding a plurality of balls; and a means for dispensing a ball to the lever mechanism.

* * * * *